US007955098B1

(12) United States Patent
McKee et al.

(10) Patent No.: US 7,955,098 B1
(45) Date of Patent: Jun. 7, 2011

(54) CARD EDGE CONNECTOR WITH AN EJECTOR ASSISTING A MEMORY CARD INSERTED THEREIN

(75) Inventors: Michael McKee, Camp Hill, PA (US); Robert Colantuono, Dover, PA (US); Richard Lee Malehorn, York, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/625,560

(22) Filed: Nov. 25, 2009

(51) Int. Cl.
*H01R 13/62* (2006.01)

(52) U.S. Cl. ..... 439/157; 439/372

(58) Field of Classification Search ..... 439/157, 439/372
See application file for complete search history.

(56) References Cited

U.S. PATENT DOCUMENTS

| | | | | |
|---|---|---|---|---|
| 4,152,038 | A * | 5/1979 | Inouye et al. | 439/153 |
| 5,163,847 | A * | 11/1992 | Regnier | 439/157 |
| 5,634,803 | A | 6/1997 | Cheng et al. | |
| 7,245,499 | B2 * | 7/2007 | Stahl et al. | 361/754 |
| 7,500,863 | B2 * | 3/2009 | Ringler et al. | 439/327 |
| 7,828,566 | B2 * | 11/2010 | Chen et al. | 439/157 |
| 2009/0186502 | A1 * | 7/2009 | Chen et al. | 439/157 |

* cited by examiner

*Primary Examiner* — Hae Moon Hyeon
(74) *Attorney, Agent, or Firm* — Wei Te Chung; Andrew C. Cheng; Ming Chieh Chang

(57) ABSTRACT

A card edge connector (100) for mating with a memory card (900) includes an elongate insulative housing (1), and a number of contacts (2) retained in the insulative housing (3); the insulative housing (1) defines a pair of side walls (11), a central slot (12) between the side walls (11), and at least a tower portion (13) at one end thereof; an ejector (3) rotatably attached to the tower portion (13) and has a body portion (31), an operation portion (32) and a lock portion (33) extending from a top end of the body portion (31), and a rotation portion (34) at a lower end of the body portion (31); wherein the rotation portion (34) has at least two adjacent dentations (3411) extending inwardly from an inner side thereof to push the memory card (900) downwardly into the central slot (12).

19 Claims, 7 Drawing Sheets

CARD EDGE CONNECTOR WITH AN EJECTOR ASSISTING A MEMORY CARD INSERTED THEREIN

BACKGROUND OF THE INVENTION

1. Field of the Invention

The present invention relates to card edge connectors, more particularly to card edge connectors with an ejector assisting a memory card inserted therein.

2. Description of Related Art

Card edge connectors are employed widely in computers to receive a memory card, graphic card, network interface card et al. The card edge connectors usually have an elongated housing, more than two hundred contacts retained in the housing for electrically connecting a corresponding mating card, and at least an ejector at one end thereof for locking the mating card. The housing has a pair of side walls and a central slot between the side walls for receiving the mating card. Each side wall defines a plurality of passageways extending therethrough along an up to down direction. The passageways communicate with the central slot. The contacts are arranged in two rows retained in the passageways of two side walls respectively. Each contact has a securing portion retained in the passageways, a contact portion extending into the central slot and a tail portion extending out of the insulative housing. The contact portions of the two rows contacts are arranged face to face for connecting with the memory card and sandwiching the memory card therebetween. The ejector has an ejecting portion at a lower side thereof for ejecting the memory card and a lock portion at an upper side thereof for locking the memory card in the central slot.

However, the two rows contact portions of more than two hundred contacts defines a space therebetween, and the space is smaller than a width of the memory card for ensuring a stable contact between the contacts and the memory card, therefore, it is are difficult for consumers to directly insert the memory card into the central slot even with a big insertion force.

Hence, an improved card edge connector is desired to overcome the above problems.

BRIEF SUMMARY OF THE INVENTION

According to one aspect of the present invention, a card edge connector for mating with a memory card, comprises: an elongate insulative housing defining a pair of opposed side walls, a central slot between the side walls, and at least a tower portion at one end thereof, the tower portion defining a pair of axes holes at two inner sides thereof; a plurality of contacts retained in the insulative housing and each having a contact portion extending into the central slot; and an ejector rotatably attached to the tower portion, the ejector having a body portion, an operation portion extending outwardly from a top end of the body portion, and a rotation portion at a lower end of the body portion; wherein the rotation portion has two pivots at two sides thereof to engage with the axes holes and at least two adjacent dentations extending inwardly from an inner side thereof to push the memory card downwardly into the central slot as rotating the rotation portion inwardly.

According to another aspect of the present invention, a card edge connector for mating with a memory card, the memory card defining a plurality of gear teeth at a lower position of a side edge thereof, the card edge connector comprises: an elongate insulative housing defining a central slot to receive a lower edge of the memory card, and a tower portion at one end thereof; a plurality of contacts retained in the insulative housing and each having a contact portion extending into the central slot; and an ejector rotatably attached to the tower portion, the ejector having a body portion, an operation portion extending from a top end of the body portion, and a rotation portion at a lower end of the body portion; wherein the rotation portion presents as a gear to mesh with the gear teeth of the memory card.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
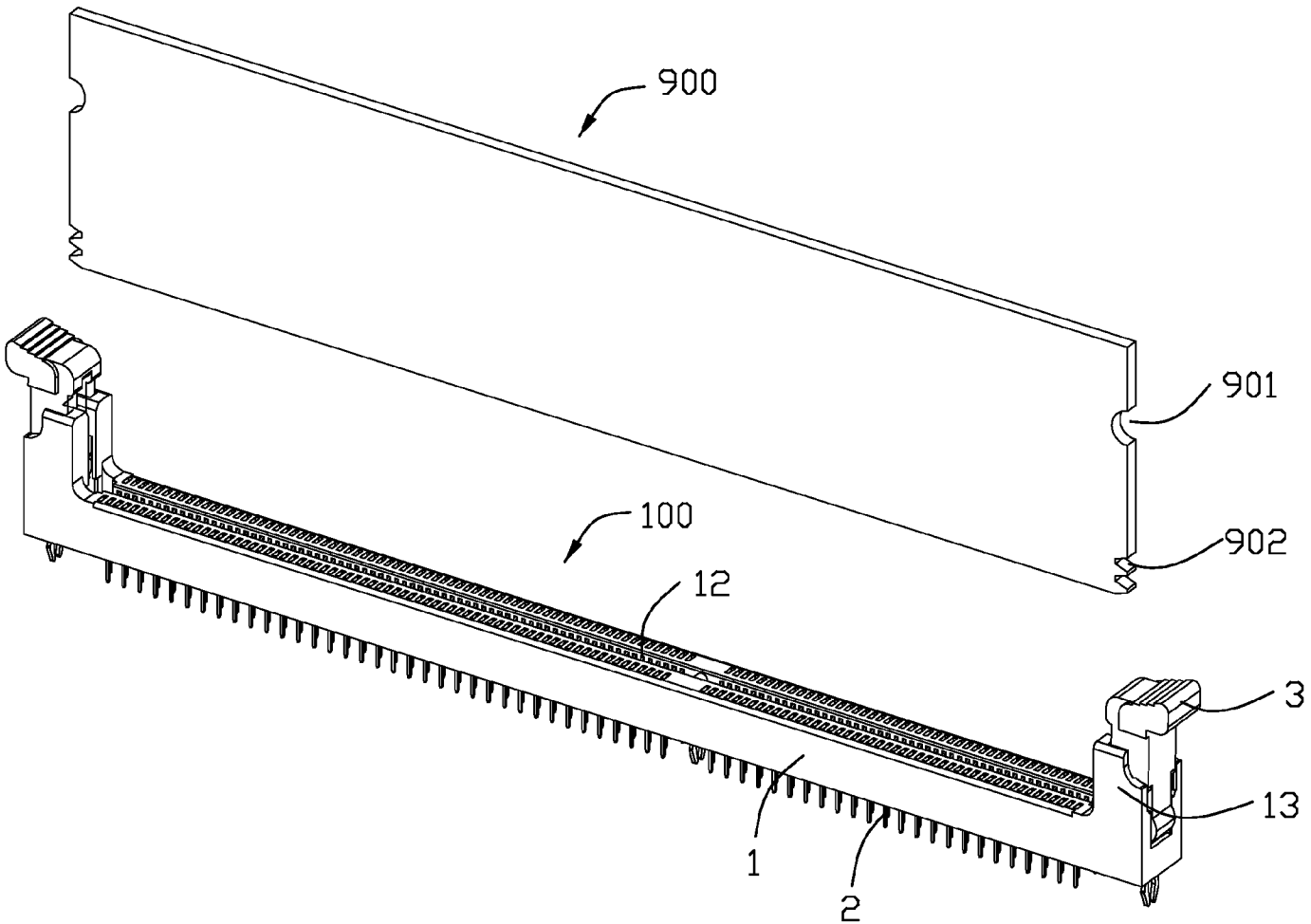
FIG. 1 is a perspective view of a card edge connector and a memory card according to the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, a card edge connector 100 for connecting with a memory card 900 according to the present invention is disclosed. The card edge connector 100 comprises an elongate insulative housing 1, a plurality of contacts 2 retained in the insulative housing 1, and a pair of ejectors 3 rotatably retained on two opposed ends of the insulative housing 1. The memory card 900 has a plurality of terminals (not shown) retained at a lower edge thereof, a pair of notches 901 at a middle position of two side edges thereof, and a plurality of gear teeth 902 at a lower position of two side edges thereof. The gear teeth 902 are spaced apart from each other along an up to down direction.

Figure 2:
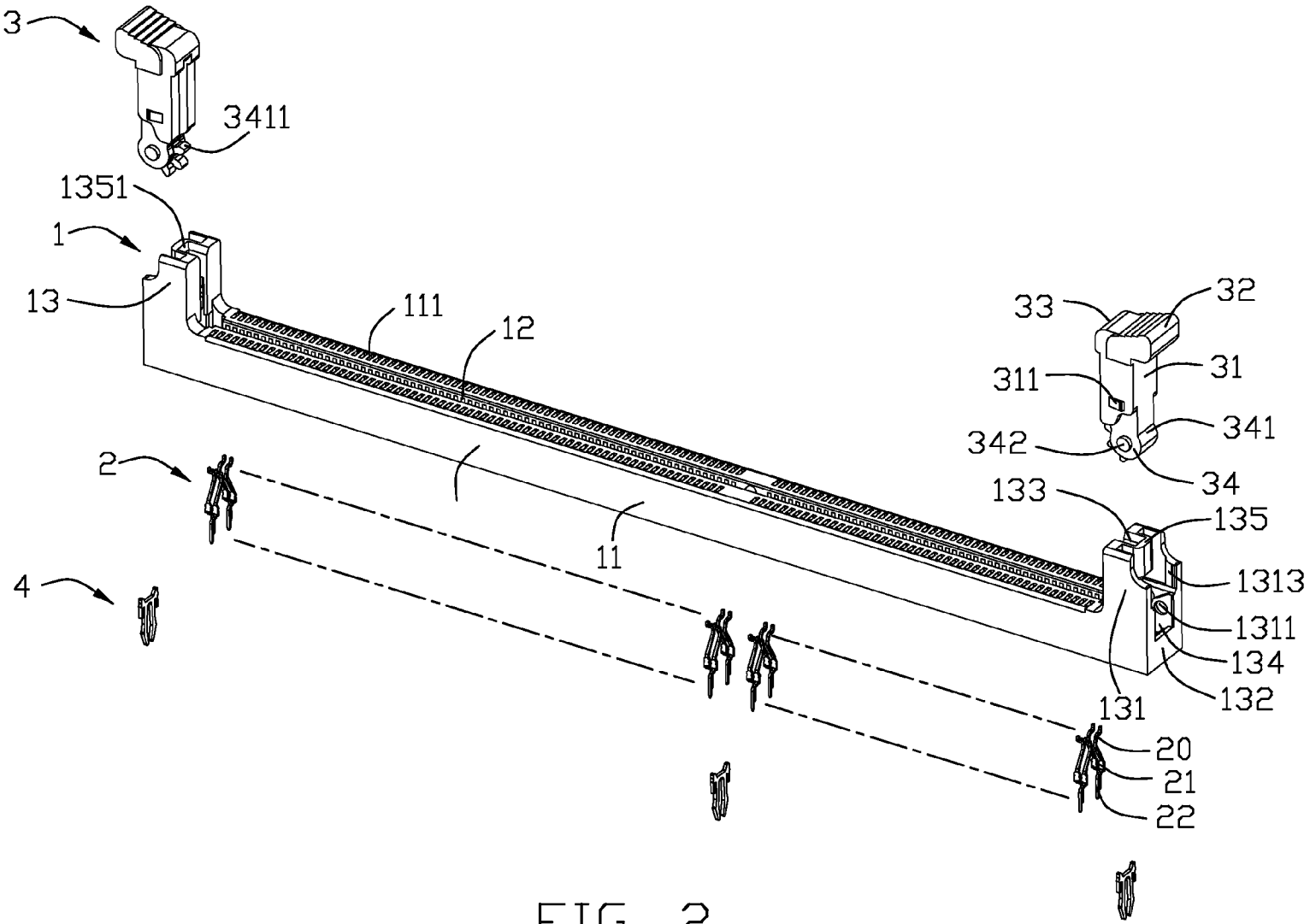
FIG. 2 is an exploded view of the card edge connector shown in FIG. 1.
Figure 3:
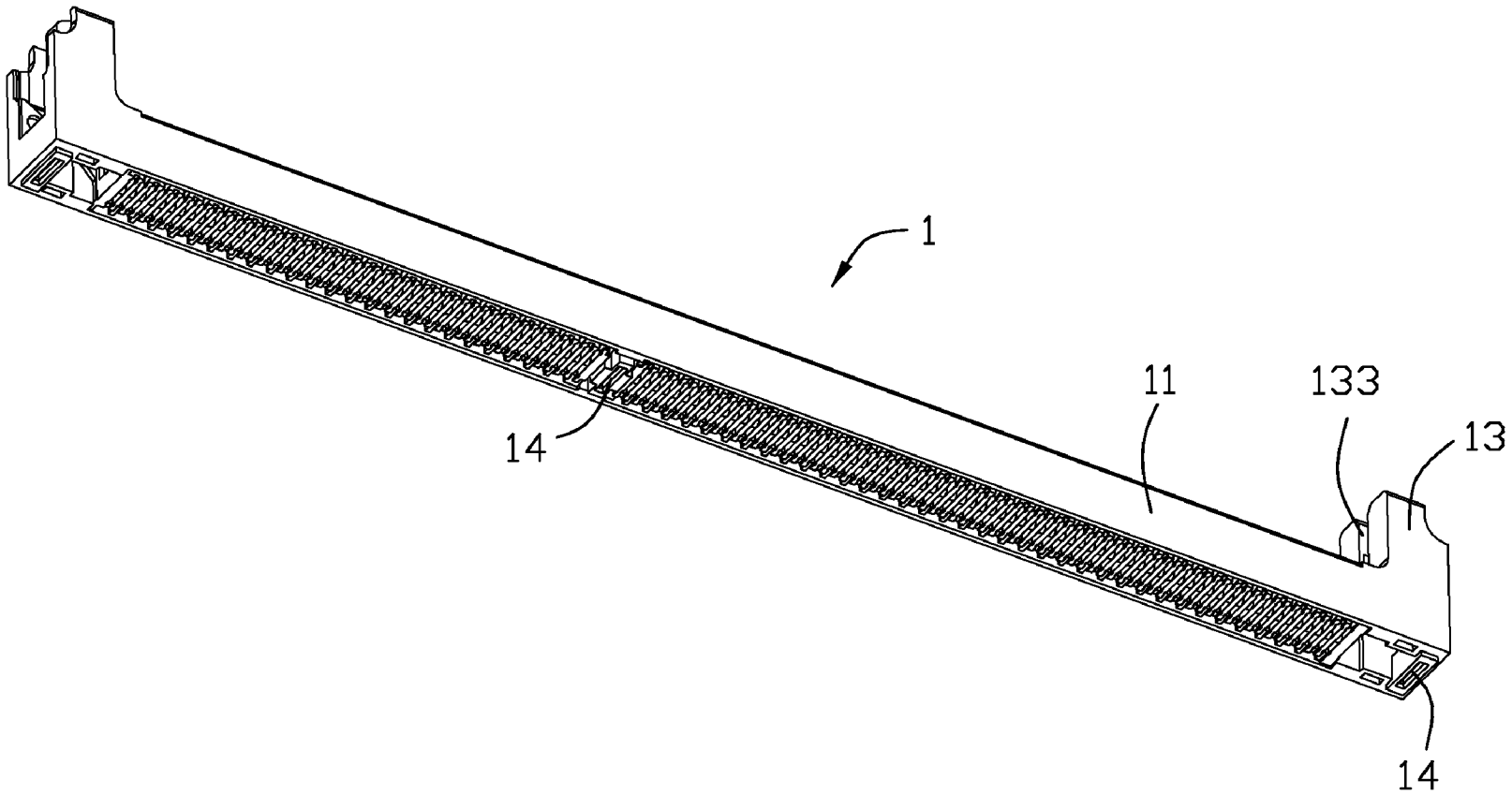
FIG. 3 is a perspective view of an insulative housing of the card edge connector shown in FIG. 1.
Figure 4:
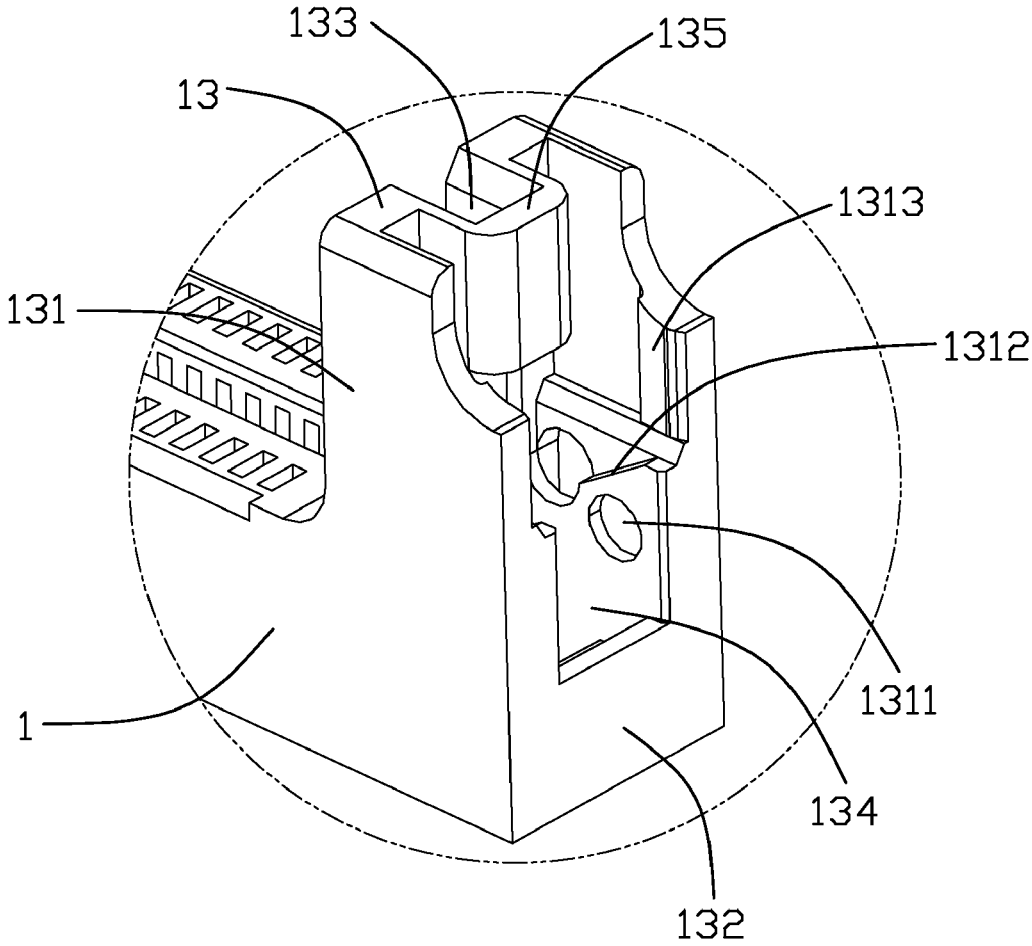
FIG. 4 is a partially enlarged view of the insulative housing shown in FIG. 3.

Referring to FIGS. 2 and 4, the insulative housing 1 has a pair of opposed side walls 11 extending along a length direction of the insulative housing 1, a central slot 12 between the side walls 11, and a pair of opposed tower portions 13 extending upwardly from two ends thereof. The central slot 12 extends along the length direction for receiving the lower edge of the electronic card 900. Each side wall 11 defines a plurality of passageways 111 extending therethrough along the up to down direction. The passageways 111 communicate with the central slot 12. The contacts 2 are arranged in two rows and retained in the passageways 111 of the side walls 11 respectively. Each contact 2 has a securing portion 21 engaging with the passageway 111, a contact portion 20 extending into the central slot 12 from one end of the securing portion 21 to contact the terminals of the memory card 900, and a tail portion 22 extending downwardly from another end of the securing portion 21. The contact portions 20 are set at two sides of the central slot 12 to electrically contact and sandwich the memory card 900. The insulative housing 1 defines a plurality of slits 14 at a bottom side thereof. The card edge connector 100 of the present invention has a plurality of board locks 4 retained in the slits 14 and extending out of the insulative housing 1 for positioning the card edge connector 100 to a circuit board (not shown).

Each tower portion 13 has a pair of side walls 131 and an end wall 132 at an outer side of the side walls 131. The tower portion 13 defines an inner cavity 133 at an inner side thereof, an outer cavity 134 at an outer side thereof, and a U-shaped limiting wall 135 between the inner cavity 133 and outer cavity 134 for preventing the ejector 3 from being rotated overly. The inner cavity 133 communicates with the central slot 12 along the length direction for receiving one side edge of the memory card 900. The outer cavity 134 is surrounded by the side walls 131, the U-shaped limiting wall 135 and the end wall 132, and communicates with the inner cavity 133 at a lower side of the U-shaped limiting wall 135. Each side wall 131 defines an axes hole 1311 to engage with the ejector 3, a first arc face 1312 extending along the length direction and located at an upper side of the axes hole 1311, and a projection 1313 extending into the outer cavity 134 from an outer side thereof and located at an upper side of the first arc face 1312. The axes hole 1311 communicates with the outer cavity 134 and is located at a position higher than the end wall 132 along the up to down direction, therefore, the ejector 3 can be rotated horizontally and resist a top end of the end wall 132. The U-shaped limiting wall 135 has a guiding face 1351 at a top end thereof for guiding the memory card 900 inserted into the inner cavity 133.

Figure 5:
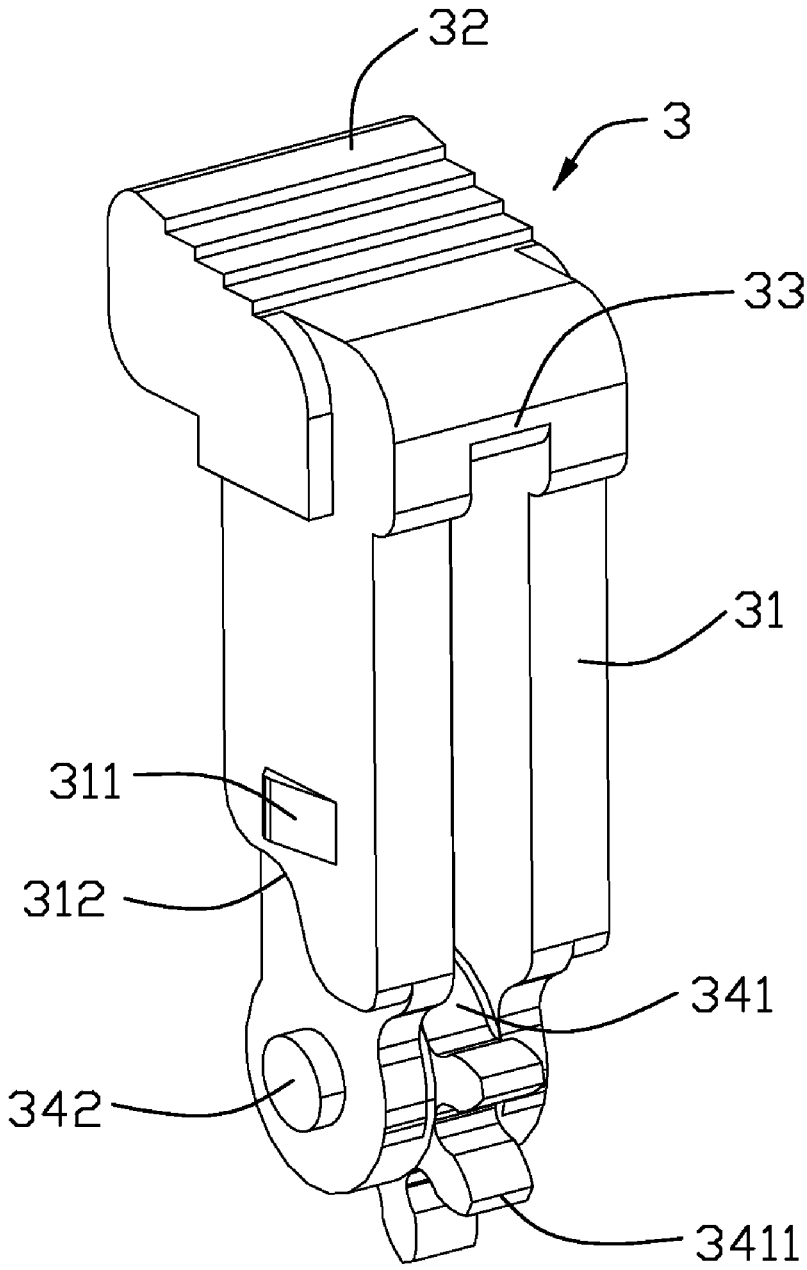
FIG. 5 is a perspective view of an ejector of the card edge connector shown in FIG. 1.

Referring to FIGS. 2 and 5, the ejector 3 is rotatablely retained in the tower portion 13, and comprises a body portion 31, an operation portion 32 extending outwardly from a top end of the body portion 31, a lock portion 33 extending inwardly from a top end of the body portion 31, and a rotation portion 34 at a lower side of the body portion 31. The body portion 31 has a pair of protrusions 311 extending outwardly from two sides thereof to lock with the projections 1313 for locking the ejector 3 in the outer cavity 134 stably, and forms with a pair of second arc face 312 at a lower side of two sides thereof to engage with the first arc face 1312 for guiding the ejector 3 being rotated outwardly. The rotation portion 34 presents as a columnar shape. The rotation portion 34 has a central axes 341 at a middle position thereof and a pair of pivots 342 extending outwardly from two sides of the central axes 341 to mate with the axes holes 1311 for positioning the ejector 3 to the tower portion 13. The central axes 341 and the pivots 342 have a same central axes line. The pivot 342 defines a diameter which is smaller than that of the central axes 341. The central axes 341 is formed with three dentations 3411 extending inwardly from a circumferential surface of an inner side thereof and received in the inner and outer cavities 133, 134. The dentations 3411 are arranged side by side in a circumferential direction to form a gear with the central axes 341. The pivots 342 can rotate in the axes holes 1311 and drive the dentations 3411 moving in the circumferential direction. The dentations 3411 can mesh with the gear teeth 902 of the memory card 900 for assisting the memory card 900 inserted into or ejected out of the central slot 12 easily.

The dentations 3411 of the present invention comprises a lower dentation 3412 to contact with a lower side of gear teeth 902, a middle dentation 3413 and an upper dentation 3414 located at an upper position of the lower dentation 3412 to mesh with the gear teeth 902 of the memory card 900. Before the memory card 900 is inserted into the central slot 12, the upper and middle dentations 3414, 3413 are located in the inner cavity 133, the lower dentation 3412 is located below the limiting wall 135.

Figure 6:
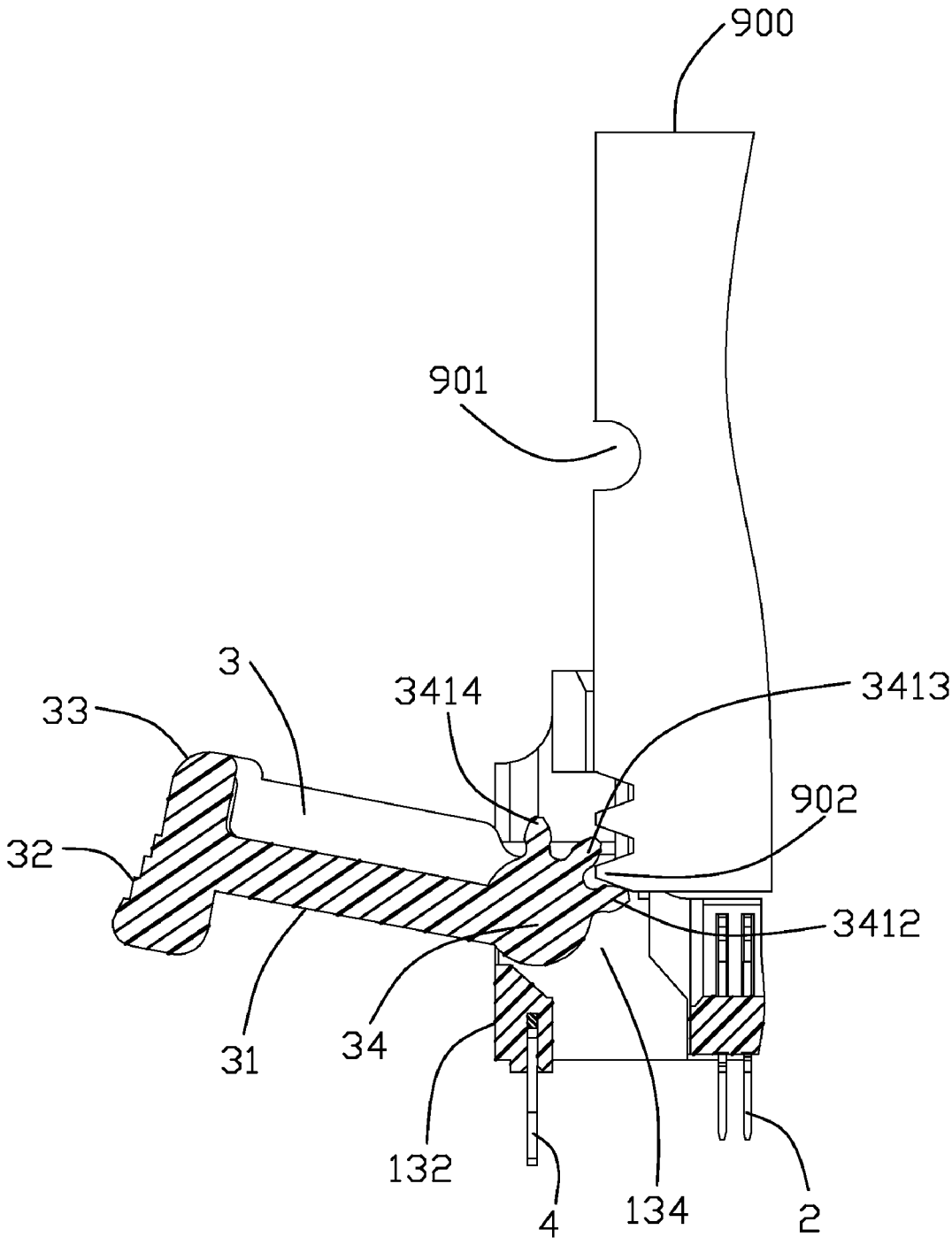
FIG. 6 is a cut-away view of the card edge connector and the memory card to show the memory card is being inserted into the card edge connector.
Figure 7:
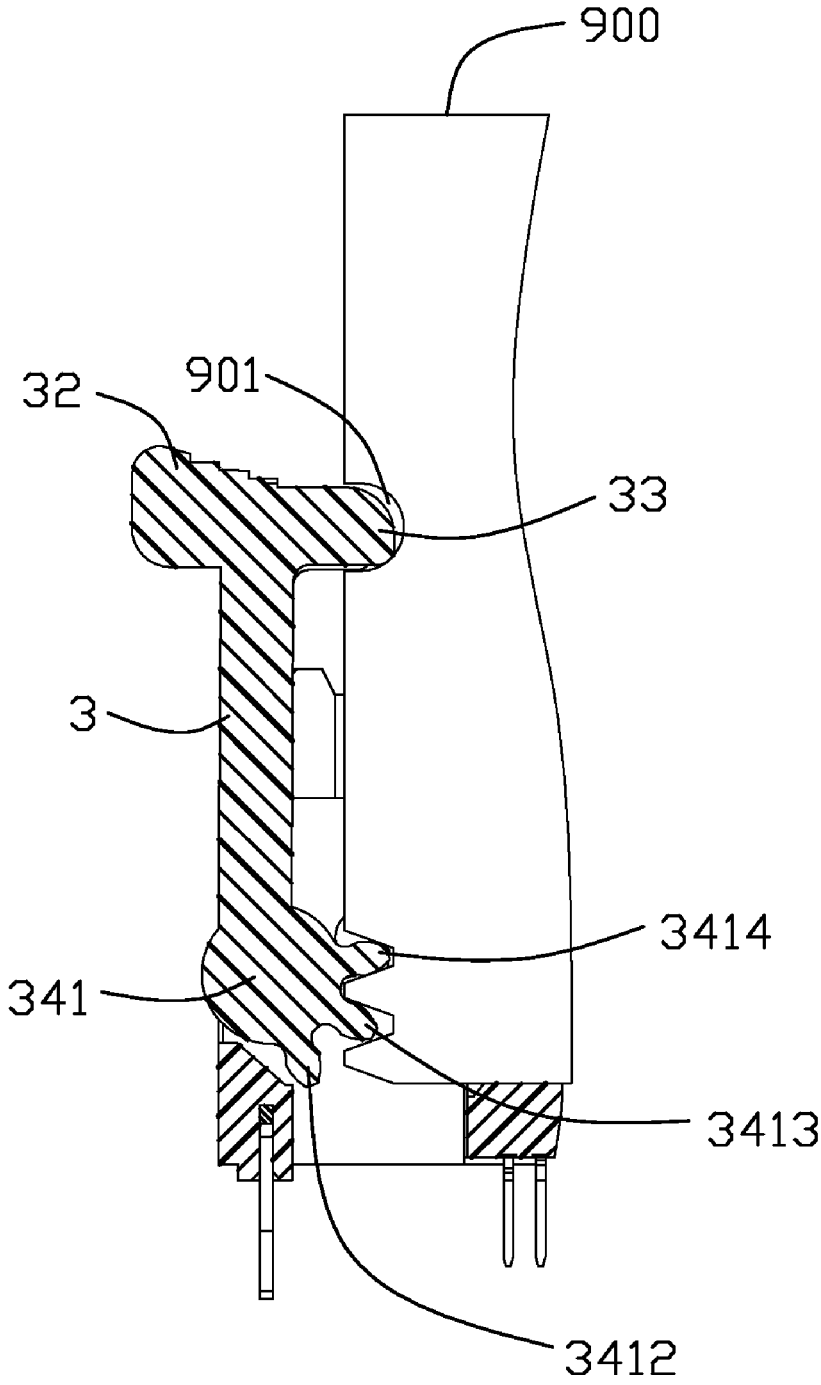
FIG. 7 is a cut-away view of the card edge connector and the memory card to show the memory card has been fully inserted into the card edge connector.

Referring to FIGS. 6 and 7, in an insertion process of the memory card 900, firstly, rotating the ejectors 3 along a counterclockwise direction before the memory card 900 is inserted into the central slot 12, here all dentations 3411 are located at a position higher than the contact portions 20 of the contacts 2, the lower and middle dentations 3412, 3413 extend into the inner cavity 133, the upper dentation 3414 extend into the outer cavity 134; secondly, inserting the memory card 900 along the guiding face 1351, when two side edges of the memory card 900 is inserted into the inner cavity 133, the lower one of the gear teeth 902 on the memory card 900 contacts with an upper side of the lower dentation 3412 and is located between the lower and middle dentations 3412, 3413; then rotating the ejectors 3 along a clockwise direction, the middle and upper dentations 3413, 3414 of the ejector 3 move into the inner cavity 133 to mesh with the gear teeth 902 of the memory card 900 gradually, the lower dentation 3412 moves into the cavity below the limiting wall 135, here the memory card 900 is pushed downwardly by the middle and upper dentations 3413, 3414 and moves toward the central slot 12; when the upper dentation 3414 of the ejector 3 meshes with an upper gear tooth 902 of the memory card 900, the memory card 900 is fully inserted into the central slot 12, and the lock portions 33 moves into the notches 901 of the memory card 900, the protrusions 311 move to an inner side of the projections 1313 to lock the ejectors 3 in the outer cavity 134 with the projections 1313.

As described above, the lower dentation 3412 does not apply an insertion force to the memory card 900 in the insertion process; and when the memory card 900 is inserted into the inner cavity 133, the memory card 900 is assisted to be pushed downwardly into the central slot 12 by the middle and upper dentations 3413, 3414, therefore, there is no need for users to impose an insertion force to the memory card 900 directly by their hands. In addition, when the memory card 900 is fully inserted into the inner cavity 133, the memory card 900 can be locked in the central slot 12 by the middle and upper dentations 3413, 3414 and the gear teeth 902 and can not move along both the up to down direction and the length direction. It can be seen that the dentations 3411 in the present invention not only assist the memory card 900 to be inserted into the central slot 12, but also lock with the memory card 900 to prevent the memory card 900 from moving along both the up to down direction and the length direction.

In an ejecting process of the memory card 900, rotating the ejector 3 along the counterclockwise direction, all the lower, middle and upper dentations 3412, 3413 and 3414 move along the counterclockwise direction and push the gear teeth 902 of the memory card 900 upwardly, and the upper and middle dentations 3414, 3413 disengage with the gear teeth 902 gradually.

As fully described above, the memory card 900 is pushed into or ejected out of the central slot 12 by the ejectors 3. The operation portion 32 and dentations 3411 are located at two ends of the ejector 3 along the up to down direction, according to leverage theory, users can rotate the ejectors 3 with a small force to insert the memory card 900 into the central slot 12 or eject the memory card 900 out of the central slot 12. Besides, the dentations 3411 forms a plurality of application points to push the memory card 900 out of the central slot 12, which can reduce an application force on the ejector 3. Therefore, the memory card 900 can be easily inserted into or ejected out of the central slot 12, and there is no need for users to impose a big application force on the memory card 900 directly. In addition, each ejector 3 is formed with three dentations 3411 at an inner side to mesh with the memory card 900, of course, the ejector 3 also can be formed with only two which is the lower and middle one 3412, 3413 or more than three dentations 3411, and the memory card 900 is formed with a plurality of gear teeth 902 corresponding to the dentations 3411 to engage with the dentations 3411, which can obtain the same purpose like the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for mating with a memory card, comprising:

an elongate insulative housing defining a pair of opposed side walls, a central slot between the side walls, and at least a tower portion at one end thereof, the tower portion defining an inner cavity at an inner side thereof to receive one side edge of the memory card, an outer cavity at an outer side of the inner cavity along both a length direction of the insulative housing and a transverse direction perpendicular to the length direction, and a pair of axes holes at two sides of the outer cavity;

a plurality of contacts retained in the insulative housing and each having a contact portion extending into the central slot; and an ejector rotatably attached to the outer cavity, the ejector having a body portion, an operation portion extending from a top end of the body portion, a rotation portion at a lower end of the body portion, and two pivots outwardly extending from two sides of the rotation portion to engage with the axes holes, the body portion having a pair of arms located at two outer sides of the inner cavity along the transverse direction and a groove between the arms to receive the side edge of the memory card;

wherein the ejector has at least two adjacent dentations extending inwardly into the inner cavity from an inner side of a middle position of the rotation portion to push the memory card downwardly into the central slot as rotating the rotation portion inwardly.

2. The card edge connector as claimed in claim 1, wherein the rotation portion presents as a columnar shape and has a central axes at a middle position thereof, the pivots extend outwardly from two sides of the central axes, the rotation portion defines a diameter which is smaller than that of the dentation and larger than that of the pivots.

3. The card edge connector as claimed in claim 2, wherein the dentations extend from a circumferential surface of the central axes and are arranged side by side in a circumferential direction to form a gear with the central axes, and a thickness of the dentations along said transverse direction is similar to a width of the inner cavity, while the rotation portion is wider than the inner cavity.

4. The card edge connector as claimed in claim 3, wherein the tower portion has a limiting wall between the inner cavity and outer cavity, the outer cavity presents as U-shape and has a pair of first outer cavities at two outer sides of the inner cavity along said transverse direction and a second outer cavity at outer side of the inner cavity along the length direction and communicating with the inner cavity at a lower side of the limiting wall to receive the ejector, and the limiting wall has a first wall between the inner cavity and the second outer cavity along said length direction and a pair of second walls between the inner cavity and the first outer cavities along said transverse direction.

5. The card edge connector as claimed in claim 4, wherein the tower portion has an inner wall at an inner side thereof, two side walls and an end wall at an outside thereof, and the outer cavity is formed between the first wall, the second walls, the side walls and the end wall, each side wall has a projection extending into the outer cavity from a rear side thereof, and the body portion of the ejector has a connecting wall connecting outer ends of the arms and received in the second outer cavities to resist the first wall and a pair of protrusions extending outwardly from the arms to engage with the projections to lock the ejector in the outer cavity stably, the arms are received in the first outer cavities, the groove is located between the arms and the connecting wall.

6. The card edge connector as claimed in claim 5, wherein the ejector has a lock portion connecting top ends of said arms and located at an upper side of the inner cavity to lock with a notch of the memory card.

7. The card edge connector as claimed in claim 1, wherein the dentations comprise a lower dentation contacting with a lower edge of the memory card and not applying an insertion force to the memory card, and a middle dentation located at an upper position of the lower dentation to mesh with the memory card and push the memory card downwardly or upwardly.

8. A card edge connector for mating with a memory card, the memory card defining a plurality of gear teeth at a lower position of a side edge thereof, the card edge connector comprising:

an elongate insulative housing defining a central slot to receive a lower edge of the memory card, and a tower portion at one end thereof, the tower portion being formed with a first arc face at an inner side thereof;

a plurality of contacts retained in the insulative housing and each having a contact portion extending into the central slot; and an ejector rotatably attached to the tower portion, the ejector having a body portion, an operation portion extending from a top end of the body portion, and a rotation portion at a lower end of the body portion, and the body portion being formed with a second arc face at outer side thereof to engage with the first arc face to guide the ejector rotating and prevent the ejector from overly moving outwardly;

wherein the rotation portion presents as a gear to mesh with the gear teeth of the memory card.

9. The card edge connector as claimed in claim 8, wherein the rotation portion has a central axes and a pair of pivots extending outwardly from two sides of the central axes to be retained in the tower portion the pivot defines a diameter which is smaller than that of the central axes, and the pivots and the central axes have a same central axes line.

10. The card edge connector as claimed in claim 9, wherein the central axes is formed with a plurality of dentations extending inwardly from a circumferential surface thereof and are arranged side by side in a circumferential direction to mesh with the gear teeth of the memory card.

11. The card edge connector as claimed in claim 10, wherein the tower portion defines an inner cavity at an inner side thereof, an outer cavity at an outer side thereof, and a limiting wall, the inner cavity communicates with the central slot for receiving the side edge of the memory card, the outer cavity communicates with the inner cavity at a lower side of the limiting wall to receive the ejector and overlaps with the inner cavity along a transverse direction perpendicular to a length direction of the insulative housing.

12. The card edge connector as claimed in claim 11, wherein the dentations extend into the inner cavity and are located at a position higher than the contact portions as the memory card does not contact the contact portions.

13. The card edge connector as claimed in claim 10, wherein the dentations comprise a lower dentation contacting with a lower side of the gear teeth and not applying an insertion force to the memory card, and a middle dentation located at an upper position of the lower dentation to mesh with the gear teeth and push the memory card downwardly or upwardly.

14. The card edge connector as claimed in claim 8, wherein the rotation portion has a plurality of dentations extending inwardly from a circumferential surface thereof, the dentations mesh with the gear teeth of the memory card as the memory card is fully inserted into the central slot for preventing the memory card from moving along both an up to down direction and a length direction.

15. The card edge connector as claimed in claim 14, wherein the tower portion has a pair of side walls and a cavity between the side walls to receive the ejector, each side wall has a projection extending into the cavity, the body portion of the ejector has a pair of protrusions extending outwardly to engage with the projections to lock the ejector in the outer cavity stably.

16. A card edge connector assembly for use with a card type memory module, comprising:

an insulative elongated housing defining a center slot for receiving a bottom portion of the module and a longitudinal end in a longitudinal direction thereof;

a plurality of contacts disposed in the housing with contacting sections extending into the center slot for mechanically and electrically connecting to the module; and at least one ejector pivotally, between an open position and a closed position, mounted to said longitudinal end of the housing, said ejector defining opposite upper and lower end sections with a rotation structure around a lower end section for supporting rotation of the ejector on the housing, and a locking portion around the upper end section for being receptively locked into a notch of the module when said ejector is located in the closed position; wherein a rotation portion is formed around said lower end section for constantly latchable engagement with a corresponding side edge region of the bottom portion of the module during assembling/disassembly the module to/from the housing in a vertical direction perpendicular to said longitudinal direction and during the rotation of the ejector between the open position and the closed position about a pivotal axis of said rotation structure which extends in a transverse direction perpendicular to both said longitudinal direction and said vertical direction;

wherein said rotation portion is provided with at least two teeth of a gear structure for latchable and compliant engagement with corresponding teeth formed on the corresponding side edge region of the module;

wherein said ejector defines two opposite side walls which are located, in the transverse direction, by two sides of the gear structure and a groove between the side walls which is adapted to further receive the side edge region of the module when said module is assembled into the housing;

wherein the longitudinal end of the housing forms a U-shaped limiting wall with therein a groove for receiving the corresponding side edge region of the module.

17. The card edge connector assembly as claimed in claim 16, wherein said rotation structure is a pivot which outward extends in said transverse direction.

18. The card edge connector assembly as claimed in claim 16, wherein the ejector has a lock portion connecting top ends of said side walls to lock with a notch of the memory module.

19. The card edge connector assembly as claimed in claim 16, wherein the two opposite side walls cooperatively sandwich said U-shaped limiting wall therebetween in the transverse direction.

* * * * *